United States Patent [19]

Quarenghi

[11] 4,241,564

[45] Dec. 30, 1980

[54] CIGARETTE PACKING MACHINES

[75] Inventor: Rodolfo Quarenghi, Bologna, Italy

[73] Assignee: Cir - S.p.A. - Divisione Sasib, Bologna, Italy

[21] Appl. No.: 960,784

[22] Filed: Nov. 15, 1978

[30] Foreign Application Priority Data

Nov. 30, 1977 [IT] Italy ..... 12854 A/77

[51] Int. Cl.[3] ..... B65B 19/24

[52] U.S. Cl. ..... 53/575; 493/164

[58] Field of Search ..... 53/563, 575, 576, 577, 53/234; 93/12 C, 44.1 R, 44.1 GT

[56] References Cited

U.S. PATENT DOCUMENTS

| | | | |
|---|---|---|---|
| 2,515,621 | 7/1950 | Willbrandt | 93/44.1 R |
| 2,603,925 | 7/1952 | Moore | 53/575 |
| 3,405,505 | 10/1968 | Mistarz | 93/44.16 TX |

FOREIGN PATENT DOCUMENTS

| | | | |
|---|---|---|---|
| 118093 | 2/1930 | Austria | 53/563 |
| 535160 | 5/1973 | Switzerland | 53/563 |
| 9165 | of 1897 | United Kingdom | 53/563 |
| 974932 | 11/1964 | United Kingdom . | |
| 1292824 | 10/1972 | United Kingdom . | |

*Primary Examiner*—John Sipos

*Attorney, Agent, or Firm*—Spencer & Kaye

[57] ABSTRACT

A cigarette packing machine of the type where a hollow packet or wrapper presenting an open head side and a closed bottom side is formed around a tubular mandrel or arbor, and a pushing plunger is provided for ejecting a group of cigarettes previously inserted at the interior of said arbor in the direction of the closed bottom side of the wrapper, further comprises a slip-off device for slipping the hollow wrapper off the arbor concurrently with the displacement of the cigarette group promoted by the pushing plunger. The slip-off device consists of a rotating friction roller arranged towards and away from said arbor, so as to cause the engagement of its peripheral friction surface with the wrapper formed on the arbor.

6 Claims, 9 Drawing Figures

CIGARETTE PACKING MACHINES

STATEMENT OF PRIOR ART

The applicant cites the following prior art, as the closest prior art of which he is aware:

British Specification No. 1,150,159 (FIGS. 1 to 8, and particularly 7 and 8).

British Specification No. 1,157,594 (Page 2, lines 95–100).

British Specification No. 1,292,824 (FIGS. 1 and 2, reference numeral 11 (puller), page 3, lines 88–105).

British Specification No. 1,166,236 (the whole document as of interest).

BACKGROUND OF THE INVENTION

The present invention relates to improvements in cigarette packing machines. More particularly, the invention relates to cigarette packing machines of the type in which an orderly group of cigarettes is enclosed in a so-called soft pack which consists of a foil wrapped around the cigarettes and of an outer paper wrapper.

In the above mentioned cigarette packing machines, a cigarette group is introduced into an open-ended tubular mandrel, called an arbor, around which the foil and paper wrapper is formed, said wrapper presenting one closed side, which corresponds to the bottom of the cigarette packet. Then, the cigarette group is pushed by a pushing plunger, which causes the said cigarette group to move through the arbor, against the bottom of the wrapper; subsequently, upon prosecution of the movement of the pushing plunger, the cigarette group, together with the wrapper vested thereonto, are slipped off the arbor and transferred to a receiving station at which suitable folders effect to the folding of the flaps at the open side of the packet, thus closing the said packet which is ready for the subsequent cellowrapping operation.

The sliding out of the wrapper, or slipping-off, from the arbor, promoted by the pushing action of the cigarette group which in its turn is pushed by the plunger, presents however an inconvenience which is due to the fact that the corners of the wrapper bottom cannot be practically squared out in a perfect manner, but have always a certain degree of roundness, so that, at high production rates of the cigarette packing machine, the cigarette group is pushed against the bottom of the wrapper at a high speed and the cigarettes located at the periphery of the bottom, particularly in the corner zones, are subjected to a brusque impact with the corresponding wrapper portions, and consequently are deformed and/or damaged.

SUMMARY OF THE INVENTION

The present invention has for its purpose to avoid this inconvenience, which mostly depends from the working rate of the pushing plunger, and it provides for the association to a cigarette packing machine of the above mentioned type, of a device for slipping off at least partially the wrapper from the tubular mandrel or arbor, in advance with respect to the movement of the cigarette group inside the said arbor promoted by the said pushing plunger, in such a manner that the head of the cigarette group does not exert any impact or pushing action against the inner side of the bottom of the wrapper, at least during the initial phase of the stroke of the pushing plunger, when the said plunger is subjected to the maximum acceleration and as a consequence there exist the most critical impact conditions of the cigarette block against the wrapper.

The above and other features of the invention, and the advantages deriving therefrom, will appear evident from the following detailed description of some preferred embodiments of same, made with reference to the attached sheets of drawings.

DESCRIPTION OF THE PREFERRED EMBODIMENT

Figure 1:
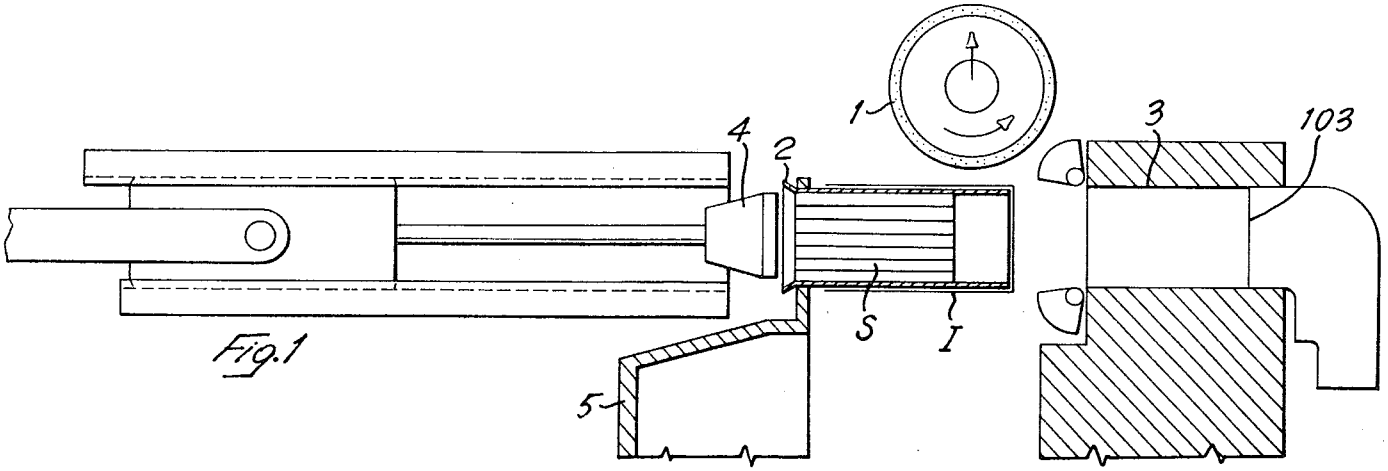
FIGS. 1 to 4 illustrate sequentially four working phases of a first embodiment of the device according to the invention for slipping the wrapper off the arbor in a cigarette packing machine.
Figure 2:
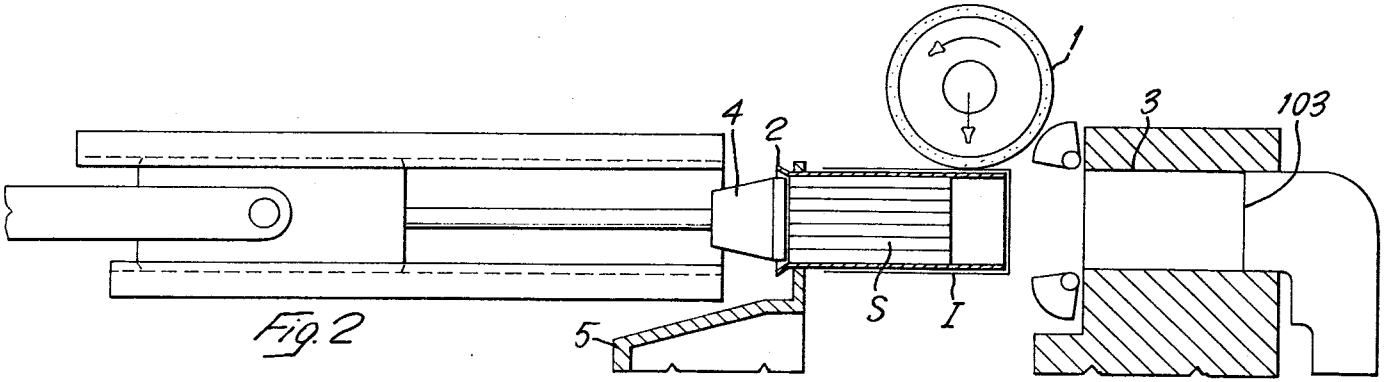
Figure 3:
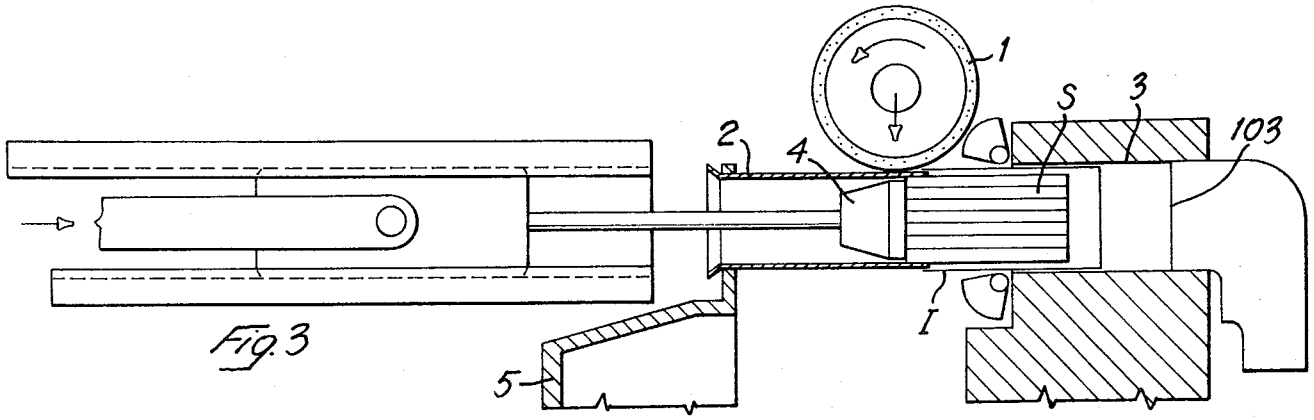
Figure 4:
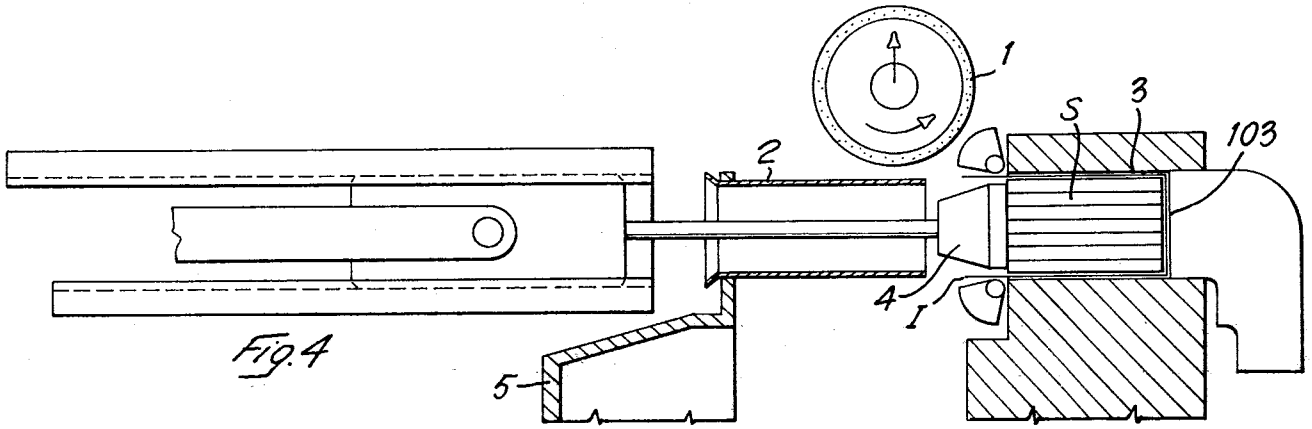

In FIGS. 1 to 5 there is shown a first embodiment in which the slip-off device consists of a friction roller 1, operatively arranged in proximity of the tubular mandrel or arbor 2 of a cigarette packing machine, in the position of alignment of said arbor 2 with the receiving channel 3 of the folding station of the cigarette packing machine. On the said tubular mandrel or arbor 2 there has been previously formed the hollow packet or wrapper I, presenting an open side. Usually, a plurality of arbors 2 is provided on a rotary drum 5 (see FIG. 5) which intermittently rotates so as to bring the arbors 2 and the wrappers I formed thereon, sequentially in alignment with the said receiving channel 3 of the folding station of the packing machine, at which folding station the flaps of the open side of the wrapper (now filled with cigarettes) are folded and the cigarette packet is closed. Inside each tubular mandrel or arbor 2 there has been previously inserted, in a known manner, a group S of cigarettes. Whenever an arbor 2 comes to be in alignment with a receiving channel 3, a pushing plunger 4 is actuated so as to push the cigarette group S from the arbor 2 inside the receiving channel 3, while the friction roller 1 enters into action and slips the wrapper I off the arbor 2 into the said receiving channel 3, concurrently with the displacement of the cigarette group S. In this manner, both the cigarette group S and the wrapper I are slipped off simultaneously from the arbor 2 into the receiving channel 3, but this is done in an independent manner, whereby the advancing head of the cigarette group S is not brought into contact with the bottom of wrapper 1.

The friction roller 1 is supported in such a manner as to assume alternatively two positions. In the first position (FIGS. 1 and 4) the friction roller 1 is spaced with respect to arbor 2, while in the second position (FIGS. 2 and 3) the friction roller 1 engages by pressure the wrapper I formed on the arbor 2. It is to be noted that the friction roller 1 usually has its peripheral surface lined with rubber or other material presenting a high friction coefficient.

In the first position of the friction roller 1 the drum 5 can intermittently rotate so as to sequentially bring the arbors 2 in alignment with the receiving channel 3. In the second position, or engaging position, the slipping of the wrapper I from the arbor 2 is obtained as a result of the friction existing between the friction roller peripheral surface and the said wrapper I. When the roller 1 has almost completely slipped the wrapper I off the arbor 2, the remaining stroke which is necessary to bring the bottom of the wrapper I against the bottom abutment member 103 of channel 3 takes place due to the pushing effect of the head of the cigarette group S against the inner side of the bottom of the wrapper. This final push is practically permissible for the following two reasons: firstly, when the head of the cigarette group S starts touching and pushing the inside of the wrapper bottom, the resistance offered by the wrapper to its sliding out off the arbor 2 is practically negligible; secondly, the pushing plunger 4 is in its deceleration phase, whereby also the impact of the advancing head of the cigarette group against the bottom of the wrapper is practically negligible.

The phases of the above slipping-off operation are clearly illustrated sequentially in FIGS. 1 to 4.

It is to be noted that, for a perfect operation of the described device, the peripheral speed of the friction roller 1 should be equal to the speed of pushing plunger 4, and in any case it must be such as to avoid the contact of the head of the cigarette group S against the bottom of wrapper I, as long as the said wrapper I is subjected to the action of the friction roller.

Figure 5:
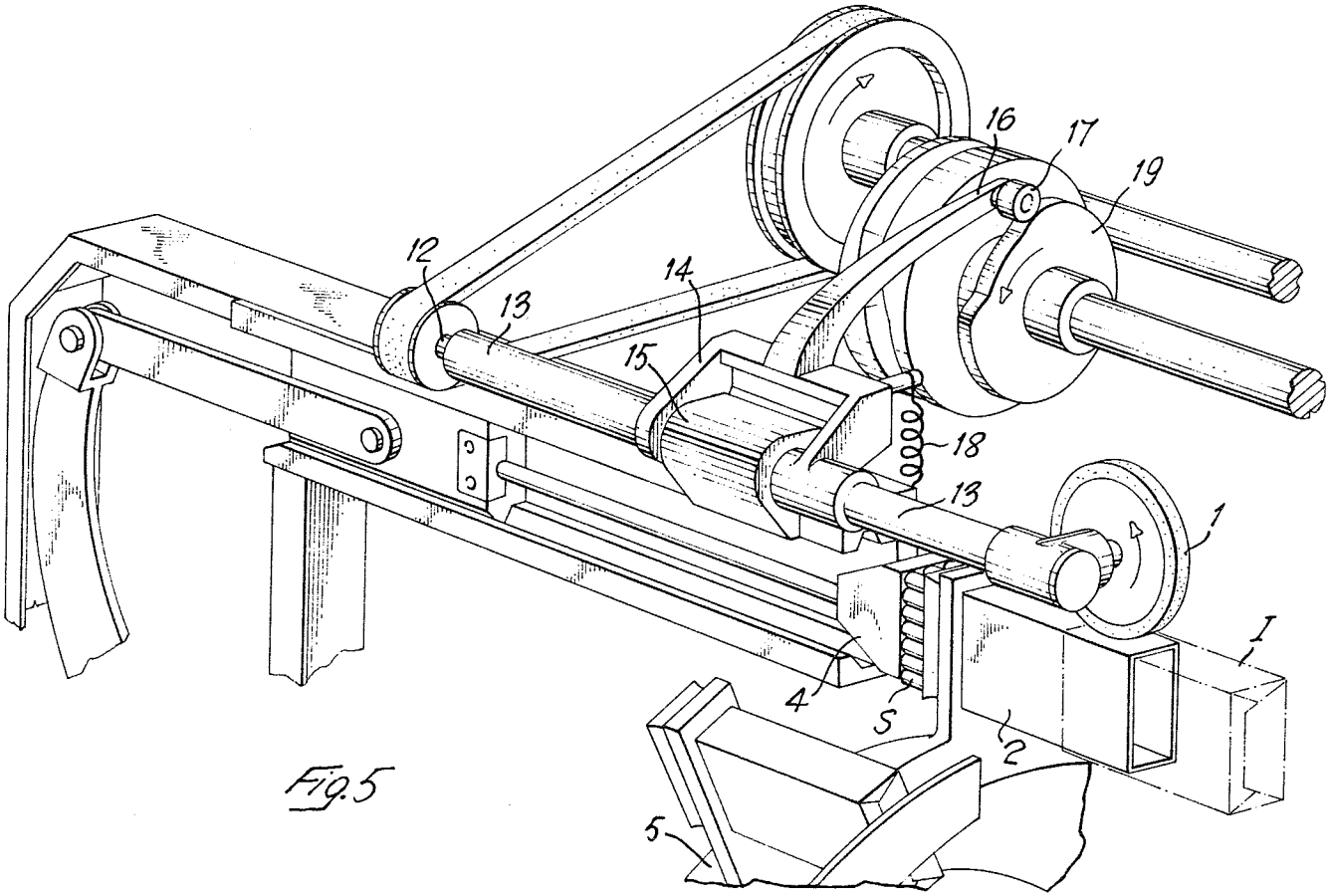
FIG. 5 shows, in perspective view a detail of the mechanism for actuating the slip-off device illustrated in FIGS. 1 to 4.

FIG. 5 shows, by ways of example, a mechanism for the actuation of the friction roller 1. The said friction roller 1 is driven into rotation by a shaft 12, through a pair of bevel gears. Shaft 12 is inserted in a pair of sleeves 13, coaxially aligned on the opposite sides of a stirrup 14 to which they are secured. This stirrup is articulated to a fixed support 15 and presents an arm 16, having at its end a roller 17. This roller 17, due to the pulling effect of a spring 18 acting on stirrup 14, is maintained in contact with the profile of cam 19. This cam is driven into rotation at suitable speed so as to cause, in perfect timing, through the oscillation of arm 16 and consequently of stirrup 14, the movement of the roller 1 towards and away from arbor 2.

MODIFICATIONS

Figure 6:
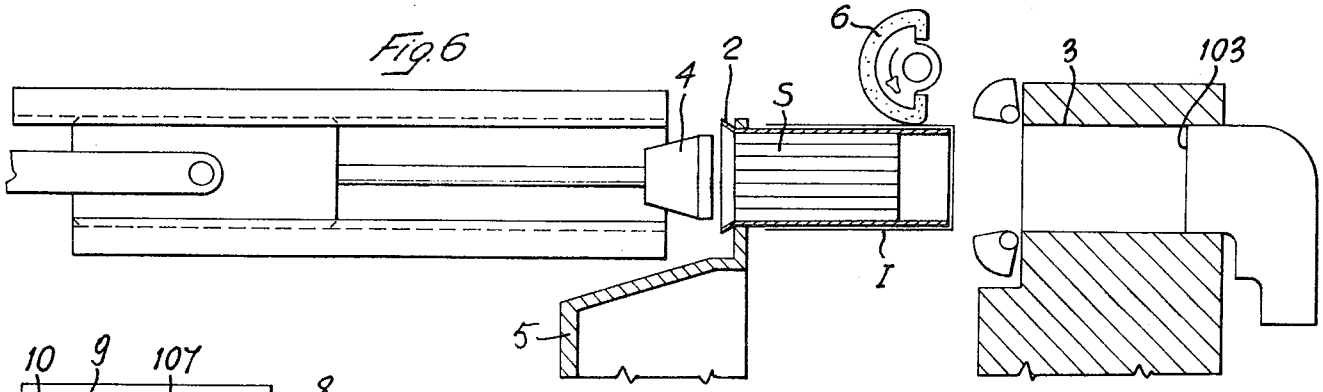
FIGS. 6, 7, 8 and 9 show as many possible modifications of the slip-off device according to the invention.

FIG. 6 illustrates schematically a second embodiment which uses a rotating rubber sector 6, which operates in synchronism with plunger 4 and accomplishes a complete revolution at every complete stroke (advance and return) of the plunger.

Figure 7:
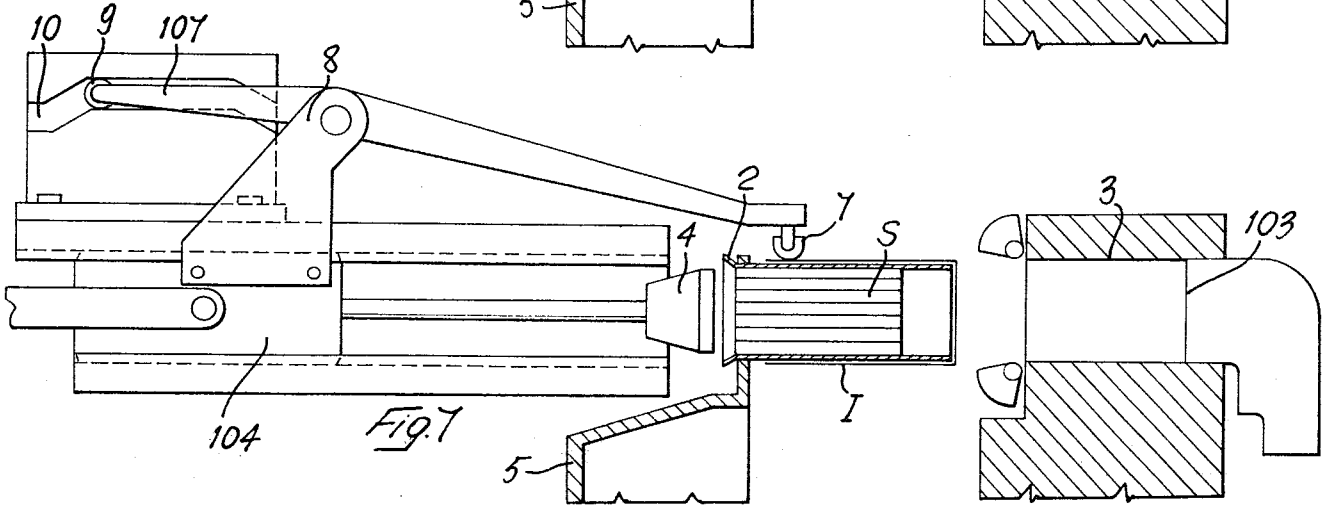

A third embodiment, illustrated in FIG. 7, employs a rubber finger 7. This element is carried at one end of a lever which is pivotally mounted on a support 8, integral with slide 104 of plunger 4. The other end 107 of the lever carrying finger 7 presents a roller 9, cooperating with a fixed cam 10. During the forward stroke of plunger 4, finger 7, which is initially in lifted position, goes down, thus coming into contact with the wrapper I on arbor 2. Then, it moves forward, slipping the wrapper off the arbor, until it gets near the arbor outlet. At this point, finger 7 is lifted to the inactive position, to allow the next arbor to come in alignment with the wrapper closing station 3. Then, as the plunger 4 moves back, the finger moves down, slides back on the arbor, and is finally lifted.

Figure 8:
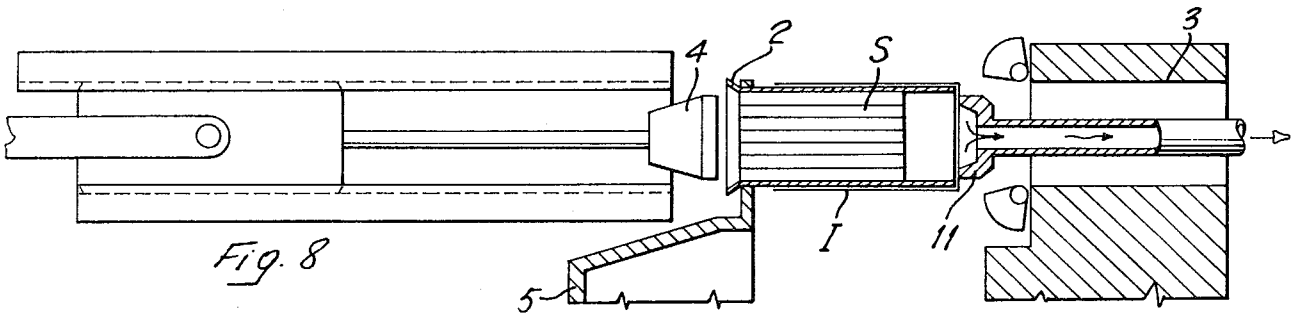

A fourth embodiment is illustrated in FIG. 8 and shows the use of a suction head 11, which is provided with a reciprocating rectilinear motion, to slip the wrapper I off the arbor 2. In this embodiment, suction head 11 completes the introduction of the wrapper in the receiving channel 3. In this embodiment, there is, obviously, no abutment member 103, this function being accomplished by the suction head 11 when it reaches the end of its stroke.

Figure 9:
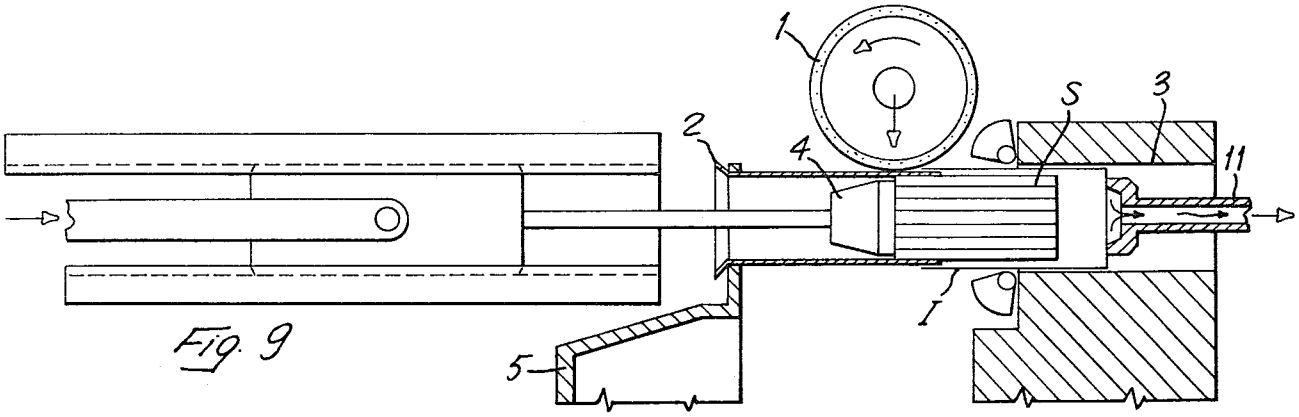

Finally, FIG. 9 illustrates a further embodiment which is formed by the combination of a rubber roller 1 with a suction head 11. Obviously, it would also be possible to combine a rotary sector 6 with a suction head 11, as well as to combine a rubber finger 7 with the suction head.

I claim:

1. A cigarette packing machine of the type where a hollow packet or wrapper presenting an open head side and a closed bottom side is formed around a tubular mandrel or arbor, the packing machine including plunger means for ejecting a group of cigarettes previously inserted at the interior of said arbor in the direction of the closed bottom side of the wrapper, and drive means to reciprocate said plunger means through said arbor, wherein the improvement comprises a slip-off device for slipping the said hollow packet or wrapper off the said arbor concurrently with the displacement of the cigarette group promoted by the said plunger means, and drive means connected for operating said slip-off device synchronously with said plunger drive means so that the cigarette group is maintained out of contact with said closed bottom side of said wrapper during at least a substantial portion of the slipping movement of said wrapper off of said arbor.

2. A cigarette packing machine according to claim 1, in which the slip-off device consists of a friction roller operatively arranged in proximity of the arbor, said friction roller being driven into rotation, means being provided for moving said friction roller laterally towards and away from the said arbor so as to cause the engagement of its peripheral friction surface with the wrapper formed on the arbor.

3. A cigarette packing machine according to claim 1, in which the slip-off device consists of a revolving sector provided on its arcuate periphery with a friction surface.

4. A cigarette packing machine according to claim 1, in which the slip-off device consists of a friction finger movable to and fro in the longitudinal direction of the arbor, means being provided for moving said friction finger laterally towards and away from said arbor so as to engage the wrapper formed on the arbor.

5. A cigarette packing machine according to claim 1, in which the slip-off device consists of a suction head movable to and fro in the longitudinal direction of the arbor and acting on the outer surface of the closed bottom side of the wrapper.

6. A cigarette packing machine according to claim 5, which further presents an additional slip-off device consisting of a friction roller operatively arranged in proximity of the arbor, said friction roller being driven into rotation, means being provided for moving said friction roller laterally towards and away from the said arbor so as to cause the engagement of its peripheral friction surface with the wrapper formed on the arbor.

* * * * *